US009419379B2

(12) United States Patent
Takeshita et al.

(10) Patent No.: US 9,419,379 B2
(45) Date of Patent: Aug. 16, 2016

(54) CONNECTOR HAVING A RECESSED CONCAVE SECTION IN A SURFACE BETWEEN A PAIR OR PARTITION WALLS BETWEEN ADJACENT TERMINALS

(71) Applicant: Yazaki Corporation, Tokyo (JP)

(72) Inventors: Ryosuke Takeshita, Kakegawa (JP); Kenichi Okamoto, Kakegawa (JP); Toshiharu Takahashi, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/689,289

(22) Filed: Apr. 17, 2015

(65) Prior Publication Data

US 2015/0303613 A1 Oct. 22, 2015

(30) Foreign Application Priority Data

Apr. 18, 2014 (JP) ..... 2014-086308

(51) Int. Cl.

| | |
|---|---|
| ***H01R 13/04*** | (2006.01) |
| ***H01R 13/631*** | (2006.01) |
| ***H01R 13/44*** | (2006.01) |
| ***H01R 13/53*** | (2006.01) |

(52) U.S. Cl.

CPC ..... *H01R 13/631* (2013.01); *H01R 13/44* (2013.01); *H01R 13/53* (2013.01); *H01R 2201/26* (2013.01)

(58) Field of Classification Search

CPC ..... H01R 24/22; H01R 24/30; H01R 13/04; H01R 13/40; H01R 13/44; H01R 13/533; H01R 2103/00

USPC ..... 439/692–694

See application file for complete search history.

(56) References Cited

U.S. PATENT DOCUMENTS

| | | | | |
|---|---|---|---|---|
| 7,114,998 | B2 * | 10/2006 | Ishikawa | H01R 13/518 439/752 |
| 2002/0039861 | A1 * | 4/2002 | Lin | H01R 33/09 439/699.2 |
| 2005/0079755 | A1 * | 4/2005 | Saka | H01R 31/085 439/404 |
| 2005/0170704 | A1 * | 8/2005 | Ishikawa | H01R 13/516 439/752 |
| 2011/0183551 | A1 * | 7/2011 | Hirano | H01R 13/4361 439/752 |

FOREIGN PATENT DOCUMENTS

JP 2012-155919 A 8/2012

* cited by examiner

*Primary Examiner* — Chandrika Prasad
(74) *Attorney, Agent, or Firm* — Sughrue Mion, PLLC

(57) ABSTRACT

A connector includes a plurality of terminals, a connector housing, a pair of partition walls and a concave section. The connector housing includes a base section on which the terminals are erected. The partition walls are erected on a bottom surface of the base section so as to intersect with a straight line connecting base end sections of a pair of the terminals adjacent to each other. The concave section is recessed into the bottom surface of the base section so as to intersect with a straight line connecting base end sections of the partition walls at adjacent side end edges of the partition walls.

3 Claims, 6 Drawing Sheets

CONNECTOR HAVING A RECESSED CONCAVE SECTION IN A SURFACE BETWEEN A PAIR OR PARTITION WALLS BETWEEN ADJACENT TERMINALS

BACKGROUND

The present invention relates to a connector.

Various kinds of electronic devices are mounted in an automobile. In addition, a wire harness is wired in order to convey power, a control signal, and the like to the electronic devices, and a plurality of electric wires and the connectors which are attached to the terminals of the electric wires are provided in the wire harness. The connectors are each provided with a terminal which is electrically connected to the end of the electric wire and a connector housing where a terminal accommodating chamber is formed which accommodates the terminal.

Here, the connector described above is used in an environment where it is easy for foreign matter (such as metal powder, water, and oil) to infiltrate into the connector housing such as, for example, lubricating oil inside an automatic transmission and a junction block which is arranged inside an engine room. In such a connector, there is a possibility that the infiltrated foreign matter adheres to the plurality of terminals and a short occurs between the terminals. It is possible to realize an insulation distance between the terminals by widening an interval (the pitch) between the plurality of terminals erected at a base section of the connector housing, but in this case the connector housing increases in size.

Therefore, in the manner of the connector which is disclosed in Patent Document 1, a connector is proposed which prevents a short occurring due to foreign matter by increasing creepage distance by providing concavities and convexities on a fitting surface of the connector housing.

As shown in FIG. 6, a connector 501 is provided with a housing 510 which is formed of a base section 511 and a cylindrical section 512, a pair of male terminals 520 and 530 which are erected on a bottom surface 514 of the base section 511, and a rib projection 540 which is projected into the bottom surface 514 of the base section 511 between the male terminals 520 and 530.

That is, by projecting the rib projection 540 to the bottom surface 514 between the male terminals 520 and 530 it is possible to realize creepage distance between the base end section of the male terminals 520 and 530 and it is possible to suppress shorts from occurring due to foreign matter.

[Patent Document 1] JP-A-2012-155919

SUMMARY

According to one aspect of the present invention, there is provided a connector comprising:

a plurality of terminals;

a connector housing which includes a base section on which the terminals are erected;

a pair of partition walls which are erected on a bottom surface of the base section so as to intersect with a straight line connecting base end sections of the adjacent terminals; and a concave section which is recessed into the bottom surface of the base section so as to intersect with a straight line connecting base end sections of the partition walls at adjacent side end edges of the partition walls.

The connector may further comprise a connecting wall which connects the pair of partition walls and is erected on the bottom surface of the base section.

The connector may be configured such that the concave section is recessed between one pair of two pairs of the adjacent side end edges, and a creepage distance between the adjacent terminals through the one pair of the adjacent side end edges is shorter than a creepage distance between adjacent terminals through the other pair of adjacent side end edges.

DETAILED DESCRIPTION OF EXEMPLIFIED EMBODIMENTS

Figure 6:
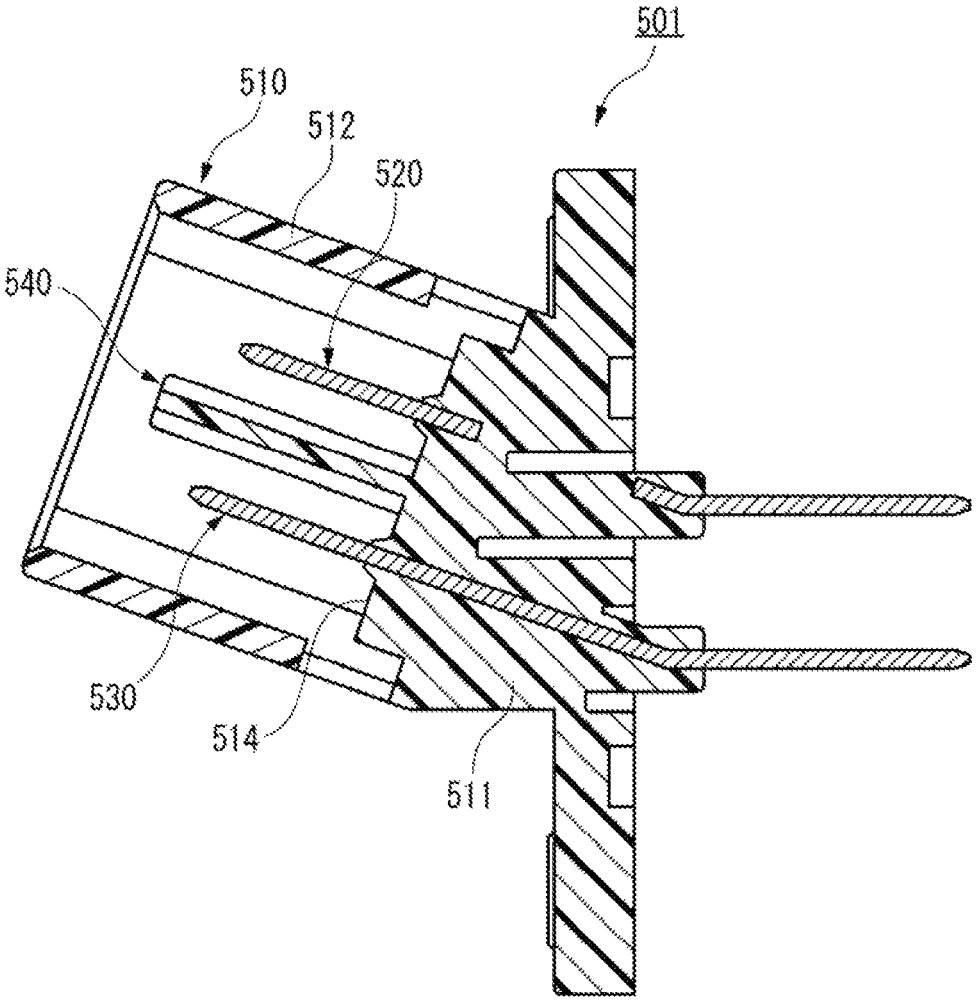
FIG. 6 is a cross sectional diagram illustrating a connector in the related art.

According to the above connector 501 of the related art as shown in FIG. 6, it is necessary to set the width dimension of the rib projection 540 larger than the width of the opposite surface of each of the male terminals 520 and 530 to realize the creepage distance between the base end section of the male terminals 520 and 530 using the rib projection 540 which is projected into the bottom surface 514. Therefore, when it is attempted to secure a sufficient creepage distance between the base end section and the male terminals 520 and 530 using the rib projection 540, it is necessary to form the rib projection 540 to be large, as a result, there is a problem in that the opening of the connector housing becomes large and the shape of the outer appearance of the connector increases in size.

It is therefore one advantageous aspect of the present invention to provide a connector where shorts between terminals due to mixing in of foreign matter are suppressed and where an increase in size is suppressed.

According to the connector of the present invention, a pair of partition walls are erected on the bottom surface of the base section so as to intersect with a straight line which connects base end sections at the adjacent terminals which are erected on a base section of the connector housing, and a concave section is recessed into the bottom surface of the base section so as to intersect with a straight line which connects base end sections at side end edges which are adjacent to the pair of partition walls. That is, creepage distance between adjacent terminals is a distance where a path which bypasses the pair of partition walls and a path which passes an opening edge or an inner surface of the concave section are added. Therefore, it is possible to secure sufficient creepage distance between adjacent terminals without setting the width dimension of the pair of partition walls larger than the width of the opposite surface of each of the adjacent terminals more than necessary. In addition, since the concave section which secures the creepage distance is recessed into the bottom surface of the base section, there is no concern of the connector housing of the fitted counterpart connector interfering and being an obstacle to the connector fitting. Here, it is possible to provide the concave section which is recessed into the bottom surface of the base section so as to pass through the base section of the connector housing.

Accordingly, compared to a case of the rib projection in the related art which projects into a bottom surface of a base section between terminals and the pair of partition walls in a case where the concave section is not recessed, with the pair of partition walls in a case where the concave section is recessed, it is possible to reduce the width dimension and it is possible to design the connector with a reduced size of the outer appearance.

According to the connector of the present invention, it is possible to increase rigidity by connecting the pair of partition walls using the connecting wall, and it is possible to make collapse difficult without increasing the sheet thickness of each of the partition walls.

Accordingly, in a case where the same partition wall interval is set, it is possible to reduce all dimensions in the sheet thickness direction with the pair of partition walls which are connected by the connecting wall compared to the pair of partition walls which are not connected by the connecting wall.

According to the connector the present invention, in a case where, for example, it is not possible for two pairs of adjacent side end edges of the pair of partition walls to have an equal creepage distance between the respective adjacent terminals due to layout limitations of a lock mechanism or the like of the connector housing, it is possible to secure the necessary creepage distance by recessing the concave section at least between the adjacent side end edges where the creepage distance is closebetween the adjacent terminals.

Accordingly, it is possible for the terminals, the partition walls, and the connector housing to have a higher degree of freedom in terms of layout, and it is possible to configure the connector in various forms.

In view of the above, according to the connector as in the present invention, it is possible to provide a connector where shorts between terminals due to mixing in of foreign matter are suppressed and where an increase in size is suppressed.

Embodiments according to the present invention will be described below with reference to the drawings.

A connector 1 according to an embodiment of the present invention, for example, is configured on an outer surface of a casing such as a junction block which is not shown in the drawings. The connector 1 is a connector (refer to FIG. 3) which electrically connects the male terminals 20 and 30 respectively to female terminals (72 and 74) by being fitted to a counterpart side connector 71 outside the casing.

Figure 1:
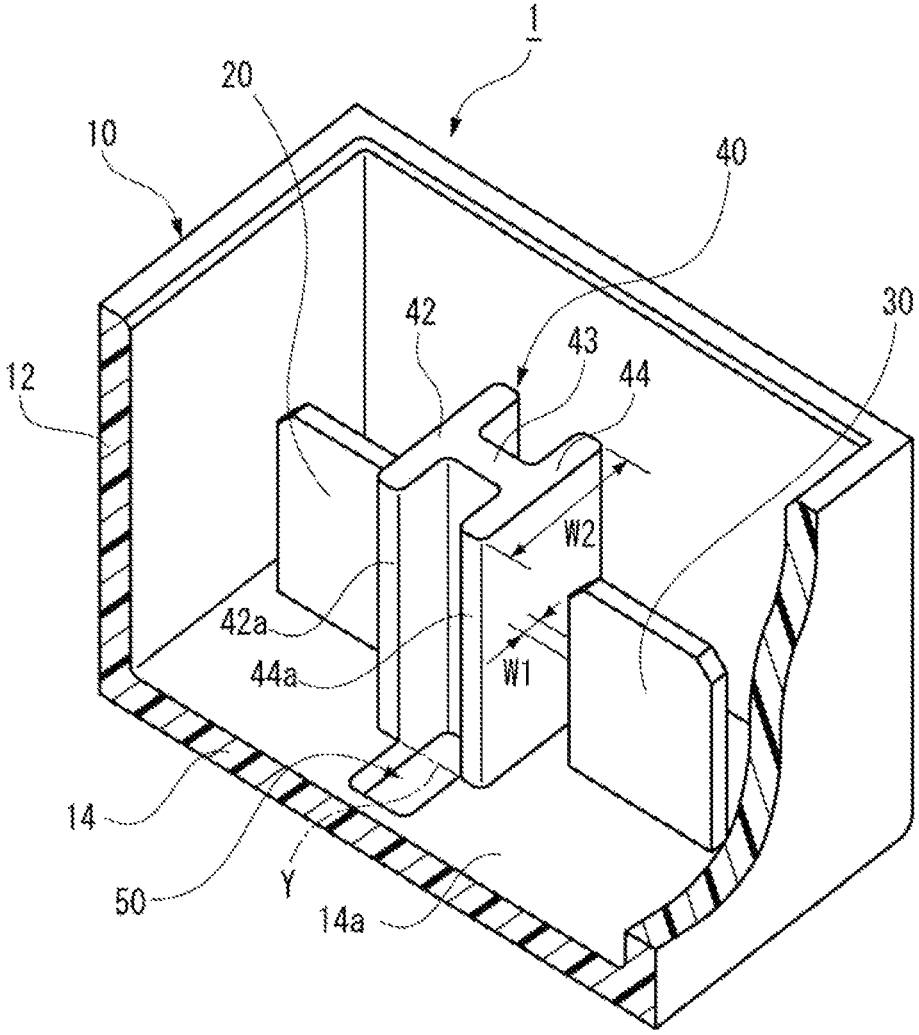
FIG. 1 is partial fracture perspective diagram illustrating a configuration of a connector according to an embodiment of the present invention.
Figure 2A:
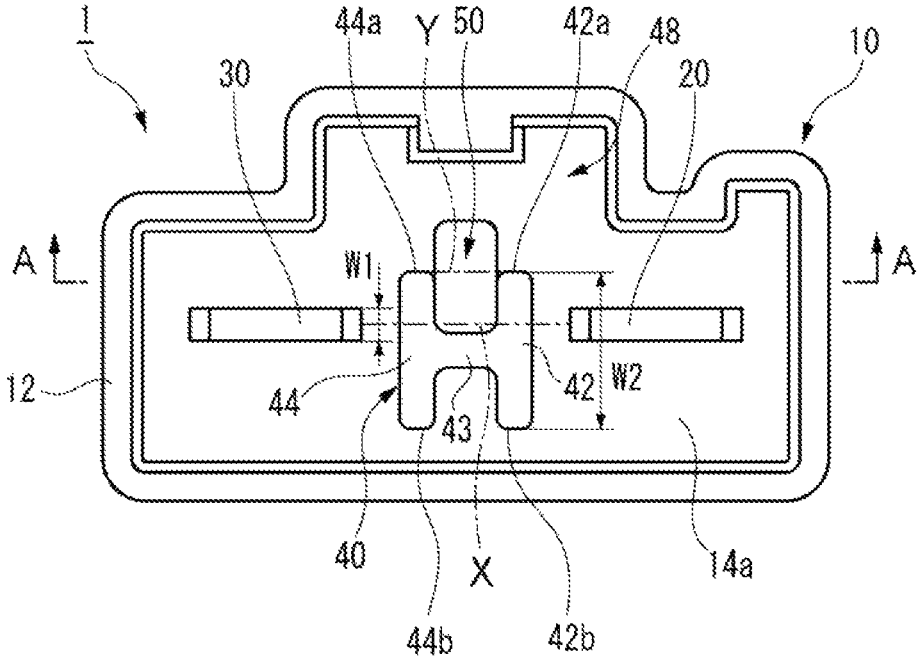
FIG. 2A is a front side diagram of the connector which is shown in FIG. 1.
Figure 2B:
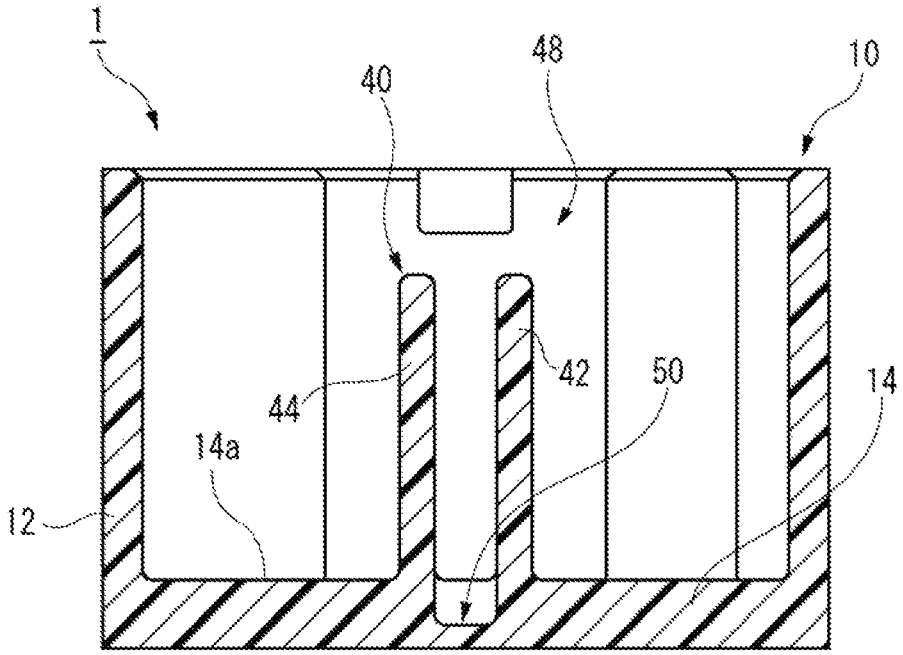
FIG. 2B is a cross sectional diagram along A-A of FIG. 2A.

As shown in FIGS. 1 to 2B, the connector 1 according to the present embodiment is provided with a plurality (two in the present embodiment) of male terminals (terminals) 20 and 30, a connector housing 10 which has a base section 14 on which the male terminals 20 and 30 are erected, a pair of partition walls 42 and 44 which are erected on a bottom surface 14*a* of the base section 14, and a concave section 50 which is recessed into the bottom surface 14*a* of the base section 14.

The male terminals 20 and 30 are tab terminals of a busbar which is formed by bending the respective conductive metal plates or the like. The male terminals 20 and 30 pass through a plurality of through holes 15 at the base section 14 of the connector housing 10 which is formed on the outer surface of the casing, and are erected on the base section 14 with the tips lined up (refer to FIG. 4). Here, in the present embodiment, a tab terminal of a busbar where the through holes 15 are passed through at the base section 14 of the connector housing 10 is described in the example as the terminal, but the terminal of the present invention is not limited thereto, and it is possible to use terminals with various forms such as a tab terminal which is erected by being insert-molded on the base section of the connector housing.

The connector housing 10 is formed of an insulating resin material, and has the base section 14 where the through holes 15, which the male terminals 20 and 30 pass through, are bored, and a cylindrical peripheral wall 12 which is provided at the peripheral edge of the base section 14. Furthermore, in the connector housing 10 when the base section 14 and the peripheral wall 12 are integrally formed, the pair of partition walls 42 and 44, and the concave section 50 are also integrally formed.

As shown in FIG. 2A, the pair of partition walls 42 and 44 are erected on the bottom surface 14*a* of the base section 14 so as to intersect with a straight line X which connects base end sections at the adjacent male terminals 20 and 30. That is, creepage distance between adjacent male terminals 20 and 30 becomes large to be a path which bypasses each of the side end edges 42*a* and 44*a* and 42*b* and 44*b* of the pair of partition walls 42 and 44 by the partition walls 42 and 44 having a width dimension W2 which is larger than a width dimension W1 of an opposite surface to each of the adjacent terminals 20 and 30. In addition, since the pair of partition walls 42 and 44 are erected to be higher than the male terminals 20 and 30 it is possible to secure a distance of an interval between the adjacent male terminals 20 and 30.

Furthermore, a connecting wall 43 which connects the partition walls 42 and 44 is erected on the bottom surface 14*a* of the base section 14 between the pair of partition walls 42 and 44. Therefore, the pair of partition walls 42 and 44 and the connecting wall 43 configure a columnar body 40 with an H-shaped cross section with high rigidity.

As shown in FIG. 1 and FIG. 2A, the concave section 50 is recessed into the bottom surface 14*a* of the base section 14 so as to intersect with a straight line Y which connects the base end sections at the adjacent side end edges 42*a* and 44*a* of the pair of partition walls 42 and 44. The concave section 50 is a cavity with a substantially rectangular shape which has a predetermined depth. That is, creepage distance between adjacent side end edges 42*a* and 44*a* of the pair of partition walls 42 and 44 becomes large to be a path which passes an opening edge or an inner surface of the concave section 50 by the concave section 50 being recessed into the bottom surface 14*a* between the adjacent side end edges 42*a* and 44*a* of the pair of partition walls 42 and 44. Here, the concave section 50 is set to be a size such that a path which passes an opening edge and a path which passes an inner surface are substantially equal. In addition, the concave section 50 of the present embodiment may be integrally formed by a portion of the opening edge being contiguous with the partition walls 42 and 44 and connecting wall 43, but the concave section of the present embodiment may be recessed into the bottom surface 14*a* such that a step is formed where the opening edge is separated from the wall surface of the partition walls 42 and 44 and the connecting wall 43. Furthermore, it is possible to configure the concave section of the present invention which is recessed into the bottom surface 14*a* of the base section 14 as a through hole which is formed through the base section 14 of the connector housing 10. In this case, it is desirable to make it difficult for foreign matter to infiltrate by arranging a portion of another member such as an insulating substrate below the base section 14 so as to cover the through hole.

Figure 3:
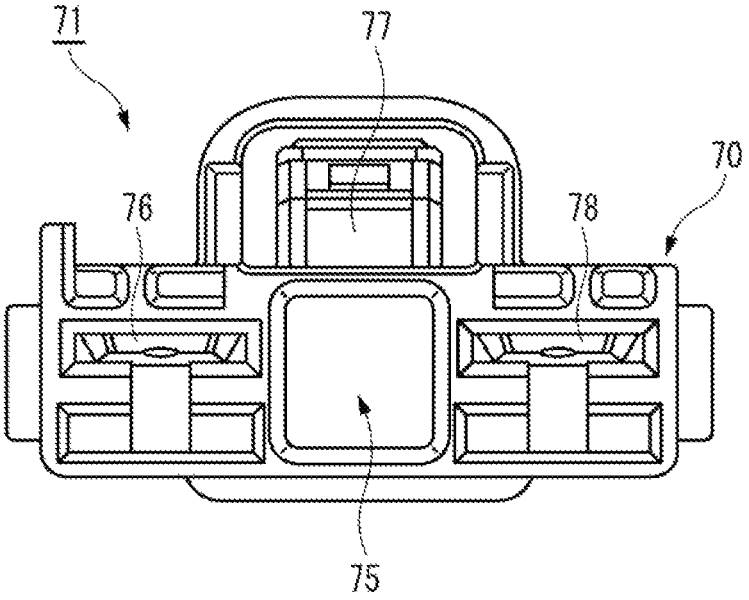
FIG. 3 is a front side diagram of a counterpart side connector which is fitted to the connector which is shown in FIGS. 2A and 2B.
Figure 4:
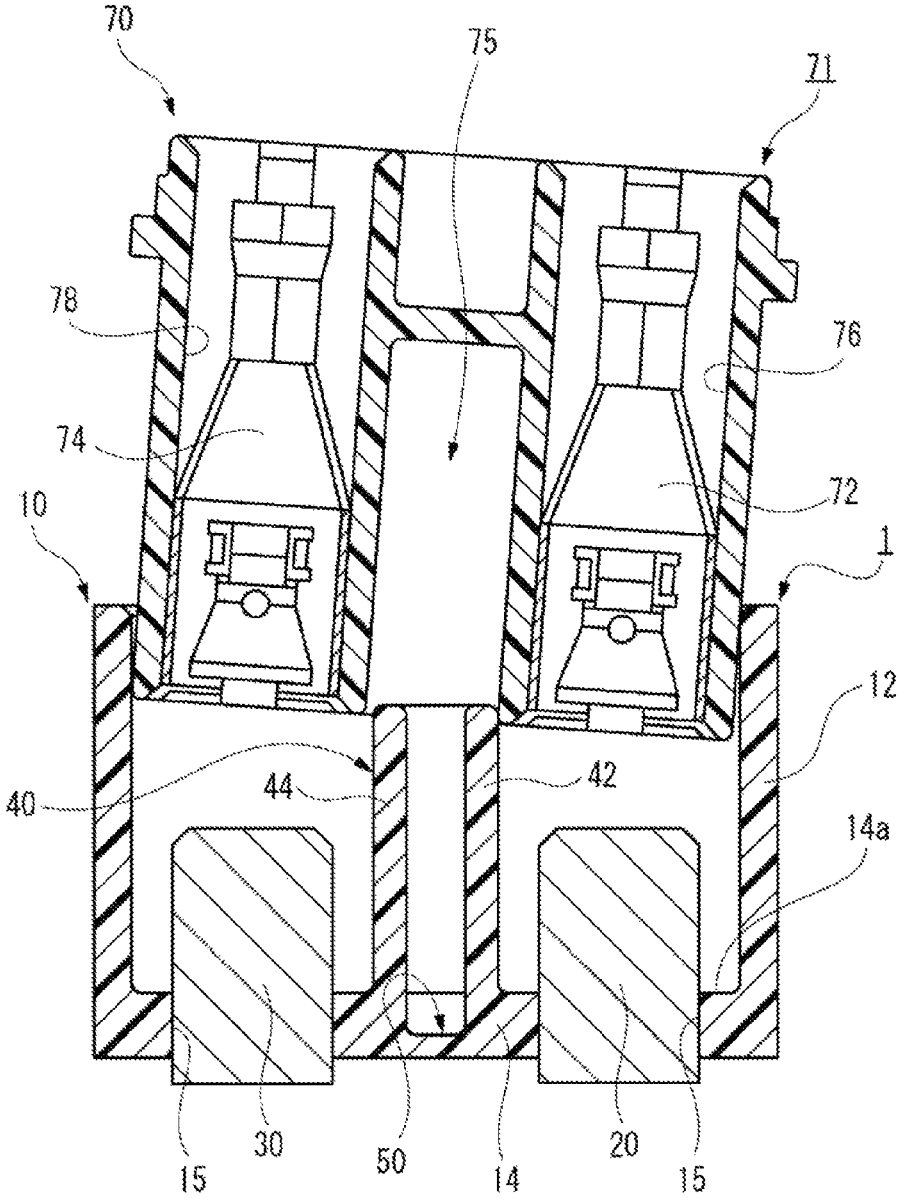
FIG. 4 is a cross sectional diagram for describing a fitted state of the connector which is shown in FIGS. 2A and 2B and the counterpart side connector which is shown in FIG. 3.

As shown in FIG. 3 and FIG. 4, the counterpart side connector 71 which is fitted to the connector 1 according to the present embodiment is provided with two female terminals 72 and 74, the connector housing 70 which has terminal accommodating chambers 76 and 78 where the female terminals 72 and 74 are accommodated, a columnar body accommodating section 75 which is recessed between the terminal accommodating chambers 76 and 78 and where the columnar body 40 of the connector 1 is fitted during connector fitting, and a locking arm 77 which is provided on the outer surface of the connector housing 70.

Therefore, as shown in FIG. 4, when the connector 1 and the counterpart side connector 71 are connector fitted, since the columnar body accommodating section 75 and the columnar body 40 provide one another with insertion guidance, it is possible for the connector housing 70 to prevent wrenching of the male terminals 20 and 30 during connector fitting.

Here, as shown in FIG. 2A, a lock receiving section 48 for receiving the locking arm 77 of the counterpart side connector 71 is formed in the connector housing 10 for the connector 1 during connector fitting. For this reason, the columnar body 40 which is formed of the pair of partition walls 42 and 44 and the connecting wall 43 is erected to be offset at the opposite side to the lock receiving section 48 with respect to the straight line X which connects the base end sections at the adjacent male terminals 20 and 30 in order to avoid interference with the lock receiving section 48. Therefore, the concave section 50 is recessed between one of two pairs of the adjacent side end edges 42*a* and 44*a*, wherein a creepage distance between the adjacent male terminals 20 and 30 through the one of the two pairs of the adjacent side end edges 42*a* and 44*a* is shorter than a creepage distance between adjacent male terminals 20 and 30 through the other pair of the two pairs of adjacent side end edges 42*b* and 44*b* if the concave section 50 is not provided.

Next, the actions of the connector 1 according to the present embodiment will be described.

In the connector 1 according to the present embodiment, the pair of partition walls 42 and 44 are erected on the bottom surface 14*a* of the base section 14 so as to intersect with the straight line X which connects the base end sections at the adjacent male terminals 20 and 30 which are erected on the base section 14 of the connector housing 10, and the concave section 50 is recessed into the bottom surface 14*a* of the base section 14 so as to intersect with the straight line Y which connects the base end sections at the side end edges 42*a* and 44*a* which are adjacent to the pair of partition walls 42 and 44.

That is, creepage distance between the adjacent male terminals 20 and 30 is a distance where a path which bypasses the pair of partition walls 42 and 44 and a path which passes an opening edge or an inner surface of the concave section 50 are added. Therefore, it is possible to secure a sufficient creepage distance between the adjacent male terminals 20 and 30 without setting the width dimension W2 of the pair of partition walls 42 and 44 larger than the width W1 of the opposite surface of each of the adjacent terminals 20 and 30 more than necessary. In addition, since the concave section 50 which secures the creepage distance is recessed into the bottom surface 14*a* of the base section 14, there is no concern of the connector housing 70 of the fitted counterpart side connector 71 interfering and being an obstacle to the connector fitting.

Accordingly, compared to the rib projection 540 (refer to FIG. 6) in the related art which projects into a bottom surface 514 of a base section 511 between the male terminals 520 and 530, with the pair of partition walls 42 and 44 in a case where the concave section 50 is recessed, it is possible to reduce the width dimension W2.

Figure 5:
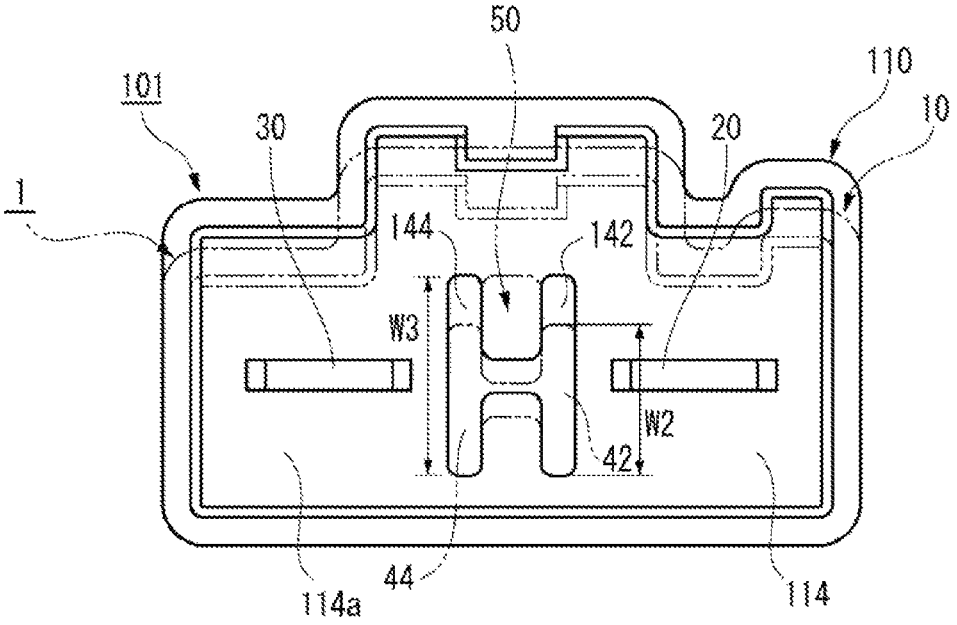
FIG. 5 is a front side diagram illustrating a connector according to a comparative example.

In addition, a connector 101 according to the comparative example which is shown in FIG. 5 is provided with the male terminals 20 and 30, a connector housing 110 which has a base section 114 where the male terminals 20 and 30 are erected, and a pair of partition walls 142 and 144 which are erected on a bottom surface 114*a* of the base section 114. However, the concave section 50 such as of the connector 1 according to the present embodiment (an imaginary line which is shown in FIG. 5) is not formed in the connector 101. Therefore, in order to realize the necessary creepage distance between the adjacent male terminals 20 and 30, it is necessary for the pair of partition walls 142 and 144 to have a width dimension W3 which is larger than the width dimension W2 of the pair of partition walls 42 and 44 according to the present embodiment. That is, accompanying an increase in the width dimension W3 of the pair of partition walls 142 and 144, the connector housing 110 also increases in size.

Accordingly, compared to the width dimension W3 of the pair of partition walls 142 and 144 in a case where the concave section 50 is not recessed, it is possible to reduce the width dimension W2 of the pair of partition walls 42 and 44 of the present embodiment where the concave section 50 is recessed, and it is possible to design the connector 1 with a reduced size of the outer appearance compared to the connector 101.

In addition, in the connector 1 according to the present embodiment, it is possible to increase rigidity by connecting the pair of partition walls 42 and 44 using the connecting wall 43 to configure the columnar body 40 with an H-shaped cross section, and it is possible to make collapse difficult without increasing the sheet thickness of each of the partition walls 42 and 44.

Accordingly, in a case where the same partition wall interval is set, it is possible to reduce all dimensions in the sheet thickness direction (the left and right direction in FIG. 2A) with the pair of partition walls 42 and 44 which are connected by the connecting wall 43 compared to the pair of partition walls 42 and 44 which are not connected by the connecting wall 43.

In addition, in the connector 1 according to the present embodiment, the lock receiving section 48 for receiving the locking arm 77 is formed in the connector housing 10. Therefore, the columnar body 40 which is formed of the pair of partition walls 42 and 44 and the connecting wall 43 is erected to be offset at the opposite side to the lock receiving section 48 with respect to the straight line X which connects the base end sections at the adjacent male terminals 20 and 30. For this reason, it is not possible for the two pairs of adjacent side end edges 42*a* and 44*a*; and 42*b* and 44*b* of the pair of partition walls 42 and 44 to have equal creepage distance between each of the adjacent male terminals 20 and 30. However, it is possible to secure the necessary creepage distance by recessing the concave section 50 between the adjacent side end edges 42*a* and 44*a* where the creepage distance is closebetween the adjacent male terminals 20 and 30.

Here, in a case where the columnar body 40 which is formed of the pair of partition walls 42 and 44 and the connecting wall 43 is erected on the straight line X which connects the base end sections at the adjacent male terminals 20 and 30, the two pairs of adjacent side end edges 42*a* and 44*a*; and 42*b* and 44*b* of the pair of partition walls 42 and 44 have equal creepage distance between each of the adjacent male terminals 20 and 30. Therefore, when the creepage distance is realized between the adjacent male terminals 20 and 30, it is possible to recess the concave section 50 both between the adjacent side end edges 42*a* and 44*a* and between the adjacent side end edges 42*b* and 44*b*.

As a result, it is possible for the male terminals 20 and 30, the partition walls 42 and 44, and the connector housing 10 according to the present embodiment to have a higher degree of freedom in terms of layout, and it is possible to configure the connector 1 in various forms.

Accordingly, according to the connector 1 as in the above embodiment, shorts between terminals due to mixing in of foreign matter are suppressed, and an increase in size is suppressed.

Here, the characteristics of the embodiment of the connector according to the present invention described above are respectively listed collectively below for ease of reference.

A connector (1) is characterized in being provided with a plurality of terminals (male terminals 20 and 30), a connector housing (10) which includes a base section (14) on which the terminals (male terminals 20 and 30) are erected, a pair of partition walls (42 and 44) which are erected on a bottom surface (14*a*) of the base section (14) so as to intersect with a straight line (X) connecting base end sections of a pair of the terminals (male terminals 20 and 30) adjacent to each other, and a concave section (50) which is recessed into the bottom surface (14*a*) of the base section (14) so as to intersect with a straight line (Y) connecting base end sections of the partition walls (42 and 44) at side end edges (42*a* and 44*a*).

The connector (1) described in above is characterized by further comprising a connecting wall (43) which connects the pair of partition walls (42 and 44) and is erected on a bottom surface (14*a*) of the base section (14).

The connector (1) described in or above is characterized by the concave section (50) being recessed between one pair of two pairs of the adjacent side end edges (42*a* and 44*a*), and a creepage distance between the pair of the terminals (male terminals 20 and 30) through the one pair of the adjacent side end edges (42*a* and 44*a*) is shorter than a creepage distance between the pair of the terminals (male terminals 20 and 30) through the other pair of adjacent side end edges (42*b* and 44*b*).

Here, the present invention is not limited to the embodiments described above and appropriate modifications, improvements, or the like are possible. In addition, it is possible to realize the present invention arbitrarily with the materials, form, dimensions, number, arrangement location, and the like of each configuring element in the embodiments described above, but the invention is not limited thereto.

For example, an example is described of a case where the connector 1 according to the embodiments above is configured on the outer surface of a casing such as a junction block, but the connector of the present invention is not limited thereto, and it is possible to apply to various connectors such as a connector which is provided with a connector housing which accommodates a terminal which is fixed to the end of an electric wire and is fitted to a counterpart side connector.

The present application is based on Japanese Patent Application No. 2014-086308 filed on Apr. 18, 2014, the content of which is incorporated herein by way of reference.

What is claimed is:

1. A connector comprising:

a plurality of terminals;

a connector housing which includes a base section having a surface on which the terminals are erected;

a pair of partition walls which are erected on the surface of the base section between a pair of the terminals adjacent to each other; and a concave section which is recessed into the surface of the base section between the pair of partition walls and that extends beyond side end edges of the partition walls.

2. The connector according to claim 1, further comprising:

a connecting wall which connects the pair of partition walls and is erected on the surface of the base section.

3. The connector according to claim 1, wherein the concave section is recessed between one pair of two pairs of the adjacent side end edges, and a creepage distance between the pair of the terminals through the one pair of the adjacent side end edges is shorter than a creepage distance between the pair of the terminals through the other pair of adjacent side end edges.

* * * * *